US008453832B2

(12) United States Patent
Skolik et al.

(10) Patent No.: US 8,453,832 B2
(45) Date of Patent: Jun. 4, 2013

(54) CONTAINER CARRIER

(75) Inventors: Bernard Skolik, Bassum (DE); Jens Eckermann, Bremen (DE); Hilger Scheelcke, Bremen (DE)

(73) Assignee: A&R Carton BV (NL)

( * ) Notice: Subject to any disclaimer, the term of this patent is extended or adjusted under 35 U.S.C. 154(b) by 660 days.

(21) Appl. No.: 10/472,340

(22) PCT Filed: Apr. 29, 2002

(86) PCT No.: PCT/EP02/04700
§ 371 (c)(1),
(2), (4) Date: Sep. 22, 2003

(87) PCT Pub. No.: WO02/092457
PCT Pub. Date: Nov. 21, 2002

(65) Prior Publication Data

US 2004/0104134 A1 Jun. 3, 2004

(30) Foreign Application Priority Data

May 15, 2001 (DE) ..... 201 08 181

(51) Int. Cl.
*B65D 75/00* (2006.01)

(52) U.S. Cl.
USPC ..... 206/170; 206/162; 206/427

(58) Field of Classification Search
USPC ..... 206/162, 170, 174, 175, 180–191, 206/193, 198, 139, 427, 434
See application file for complete search history.

(56) References Cited

U.S. PATENT DOCUMENTS

| | | | | |
|---|---|---|---|---|
| 2,540,067 | A | 3/1949 | Williamson | |
| 3,084,831 | A | 5/1960 | Arneson | |
| 3,402,872 | A | 7/1966 | Forrer | |
| 3,412,894 | A | 11/1968 | Wood | 220/113 |
| 3,747,801 | A * | 7/1973 | Graser | 206/193 |
| 3,797,729 | A * | 3/1974 | Holmes | 206/194 |
| 4,258,844 | A * | 3/1981 | Stout | 206/288 |
| 5,031,760 | A | 7/1991 | Stout | 206/180 |
| 5,040,672 | A * | 8/1991 | DeMaio et al. | 206/162 |
| 5,423,420 | A * | 6/1995 | Bakx | 206/139 |
| 5,505,304 | A * | 4/1996 | Broskow et al. | 206/427 |
| 5,579,904 | A | 12/1996 | Holley, Jr. | 206/180 |
| 5,611,425 | A | 3/1997 | Holley, Jr. | 206/144 |
| 6,221,212 | B1 | 4/2001 | Sjostrom | |

FOREIGN PATENT DOCUMENTS

| | | | |
|---|---|---|---|
| DE | 2 322 995 | A1 | 11/1974 |
| DE | 299 11 034 | U1 | 10/1999 |
| EP | 0 017 307 | B1 | 4/1984 |
| EP | 0 916 590 | A2 | 5/1999 |
| WO | 98/10998 | A1 | 3/1998 |
| WO | 98/31603 | A1 | 7/1998 |

* cited by examiner

*Primary Examiner* — J. Gregory Pickett
(74) *Attorney, Agent, or Firm* — Vidas, Arrett & Steinkraus, P.A.

(57) ABSTRACT

A container carrier which is made of a foldable flat material. The container carrier includes a box-shaped carrying container which is open at top and has a bottom wall, longitudinal walls, and end walls, a middle wall parallel to the two longitudinal walls in the carrying container that has a carrying handle at top. The container carrier also includes transverse webs parallel to the end walls between the middle wall and the longitudinal walls for forming compartments in the carrying container to receive containers therein, and outwardly inclined bottom slopes which are joined to the longitudinal-sided edges of the bottom wall at bottom and to the lower edges of the longitudinal walls at top.

12 Claims, 4 Drawing Sheets

(a)
(b)
ohne Bodenverstärkung (a)
(b)
mit Bodenverstärkung

CONTAINER CARRIER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to container carriers made of a foldable flat material which comprises a box-shaped carrying container which is open at top and has a bottom wall, longitudinal walls and end walls, a middle wall parallel to the two longitudinal walls in the carrying container that has a carrying handle at top, and transverse webs parallel to the end walls between the middle wall and the longitudinal walls for forming compartments in the carrying container to receive containers therein.

Basket-type container carriers of this type ("Open Basket Carriers") are known. They may be manufactured from one or more cut-to-size panels of a foldable flat material. They mostly are made of cardboard. They specifically serve for keeping and carrying bottles, mainly beverage bottles.

A problem for such container carriers is stability. The container carrier requires to be prevented from getting torn when under loads during the packaging process and during the transport of containers inserted. For this purpose, structural measures and others that concern the selection of materials are described in EP 916 590 A and DE 299 11 034 U.

Accordingly, it is the object of the invention to provide container carriers of the previously mentioned type which are of an improved stability.

The container carrier made of a foldable flat material comprises:

- a box-shaped carrying container which is open at top and has a bottom wall, longitudinal walls and end walls,
- a middle wall parallel to the two longitudinal walls in the carrying container that has a carrying handle at top,
- transverse webs parallel to the end walls between the middle wall and the longitudinal walls for forming compartments in the carrying container to receive containers therein, and
- outwardly inclined bottom slopes which are joined to the longitudinal-sided edges of the bottom wall at bottom and to the lower edges of the longitudinal walls at top.

The fact that the container carrier has bottom slopes on the two longitudinal sides surprisingly helps achieve a significant improvement in the stability of the container carrier. Studies have revealed that the bottom slopes retain in place the containers inserted in the container carrier at the lower edge so that the containers are prevented from movements that considerably contribute to material failure. Those are a "jerking motion" of the containers in the compartments which makes itself felt particularly if a lowering motion of conventional container carrier is heavily delayed or is abruptly ceased. This movement of the containers may specifically cause the material to crack in the end walls. In the inventive container carrier, this is avoided by holding in place merely the lower edge of the containers with no prejudice to the insertion or removal of the containers. Since stability is improved it becomes easier to employ less strong materials which are less costly or have a smaller weight, e.g. cardboard of a relatively low grammage or recycled cardboard boxes.

The container carrier preferably serves for carrying bottles. In many cases, between the bottom and cylindrical shell, these have an inclined or rounded lower external area which advantageously interacts with the bottom slopes of the container carrier. According to a preferred aspect, the inclination of the bottom slopes towards the middle wall is approximately equal to the inclination of the lower bottle edges towards the bottle axis or will exceed it somewhat so that the bottles will be pinched the more intensely the more they are lowered into the compartments.

To further enhance strength, the middle wall is joined to the two end walls at its end sides and/or the transverse webs are joined to the middle wall and longitudinal walls at their end sides.

BRIEF SUMMARY OF THE INVENTION

Further, the object is achieved by a container carrier made of a foldable flat material. This container carrier comprises:

- a box-shaped carrying container which is open at top and has a bottom wall, longitudinal walls, and end walls,
- a middle wall parallel to the longitudinal walls in the carrying container that has a carrying handle at top,
- transverse webs parallel to the end walls between the middle wall and the longitudinal walls for forming compartments in the carrying container to receive containers therein,
- central folding lines in the end walls and the bottom wall to planely fold the container carrier, and
- a material reinforcement which is disposed at a end-sided edge of the bottom wall and extends through the central folding line of the bottom wall.

The material reinforcement is located at a position of the bottom wall at which a press-open device of an erecting machine is engaged to set upright the container carrier from the flat-lying condition in the packaging process. This press-open device applies a force to the edge of the bottom wall that has been considered not to be critical for the cardboard qualities conventionally employed for container carriers (e.g. kraft cardboard having a grammage of 305 g/m$^2$). Surprisingly, it has now been shown that container carriers may be smoothly produced on the conventional erecting machines and may also be manufactured from less strong flat material if they have the material reinforcement. This particularly makes it possible to manufacture the container carrier from a kraft cardboard having a grammage of less than 305 g/m$^2$, specifically a grammage of 250 g/m$^2$, or from a recycling material which hitherto would not have sustained the loads applied in the erecting process.

Preferably, the cross extension of the material reinforcement is substantially equal to the cross extension of the bottom wall, i.e. the material reinforcement extends approximately across the width of the bottom wall. It has been shown that a material reinforcement which merely is punctiform on the central folding line where normally the press-open device is engaged gives no decisive improvement in stability.

Basically, the material reinforcement may be a foldable flat material which is additionally applied, or even a different material, e.g. an adhesive tape or "kraft tape". According to a preferred aspect, the material reinforcement is a reinforcing flap folded about the end-sided edge of the bottom wall against a side of the bottom wall. Preferably, the reinforcing flap is folded against the inner surface of the bottom wall, which makes it easier to use cardboard material which is coated on one side only.

For example, the longitudinal extension of the material reinforcement may be approximately equal to half the longitudinal extension of the bottom wall. This is an advantage for strength and, nevertheless, allows to manufacture the cut-to-size panels with no major material losses, i.e. permits a favourable "panel partition".

Preferably, the material reinforcement is adhered to the bottom wall. This pasting may be done together with any further pastings that the container carrier exhibits.

The two solutions and their aspects may also be combined with each other at will.

BRIEF DESCRIPTION OF THE SEVERAL VIEWS OF THE DRAWINGS

The inventions will be described below with reference to the accompanying drawings of embodiments. In the drawings:

FIG. 3 shows a flat-spread cut-to-size panel of a container carrier with a reinforcing flap to reinforce the bottom wall in a plan view;

The same reference numbers will be used for substantially identical constructional elements in the explanation which follows for various embodiments.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
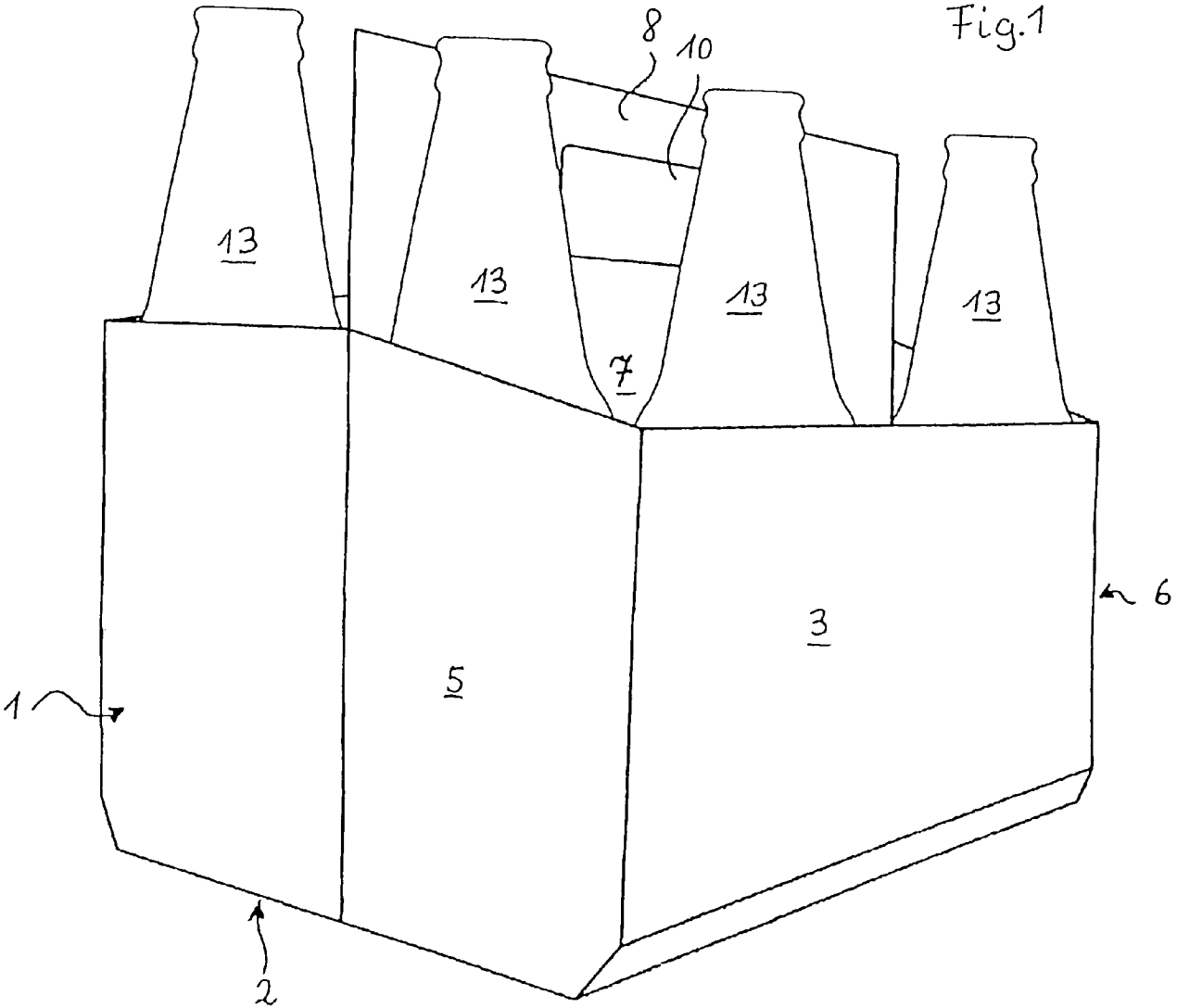
FIG. 1 shows a container carrier with bottom slopes in a perspective side view.
Figure 2:
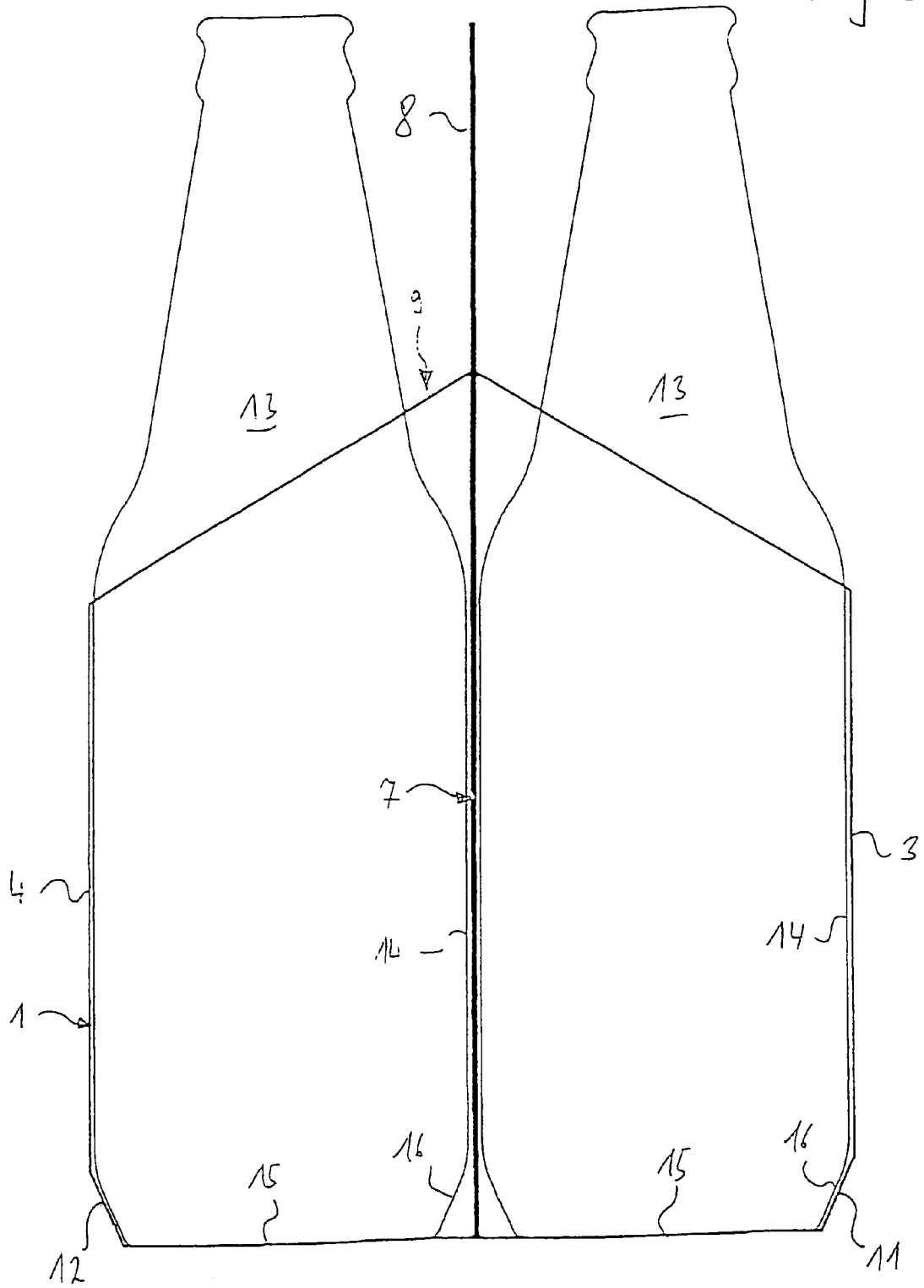
FIG. 2 shows a container carrier with bottom slopes in an end-side view.
Figure 2:
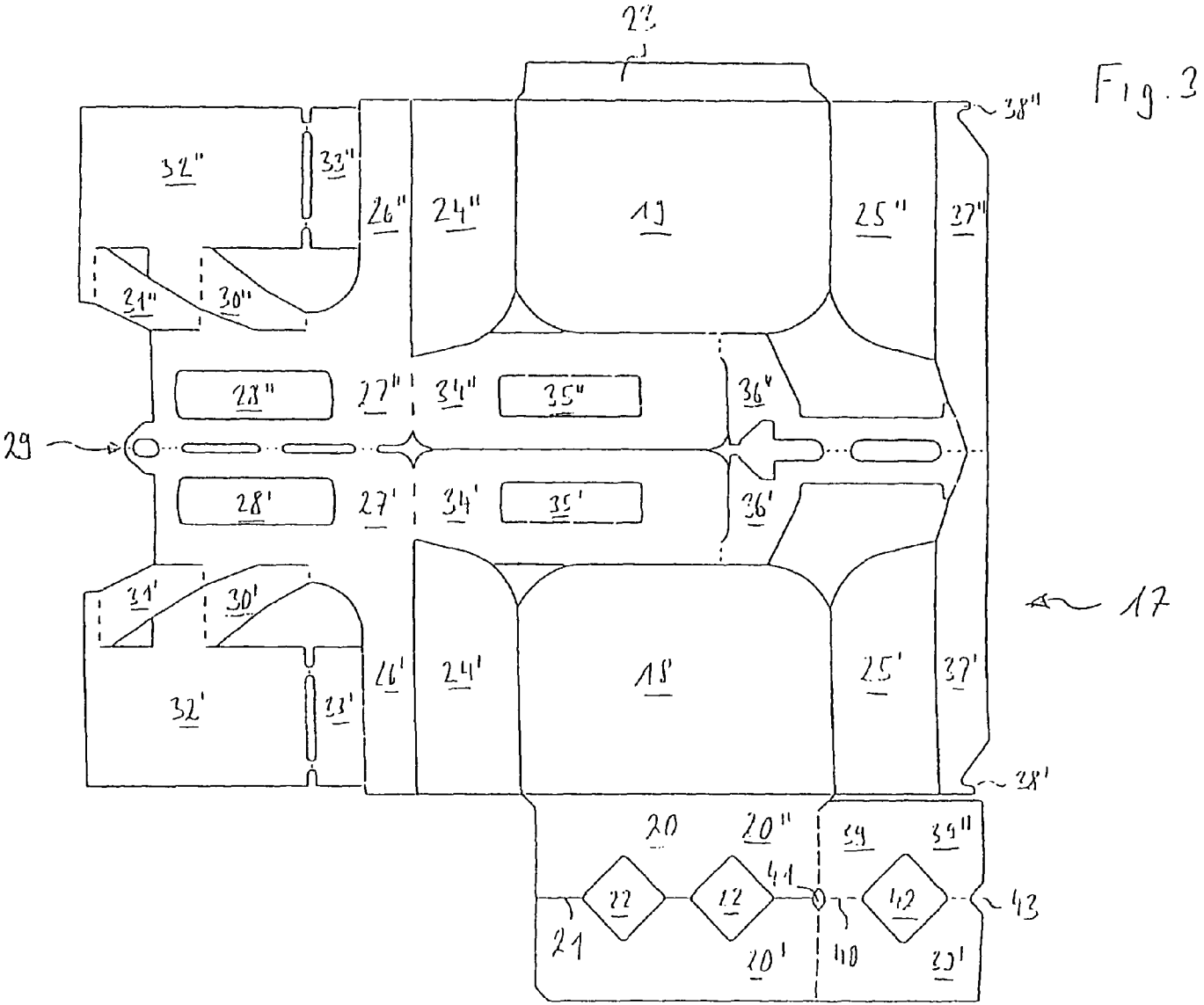

Referring to FIGS. 1 and 2, a container carrier of cardboard material has a box-shaped carrying container 1 which exhibits a bottom wall 2, longitudinal walls 3, 4, and end walls 5, 6. Further, the carrying container has a middle wall 7 which is centrally disposed in the carrying container 1 in parallel with the longitudinal walls 3, 4. The middle wall 7 has a carrying handle 8 which protrudes beyond the top-sided aperture 9 of the container carrier 2 and has a gripping aperture 10.

The middle wall 7 is joined to the end walls 5, 6 via flaps (not shown) at the ends. Furthermore, the middle wall 7 is hooked to the bottom wall 2 via a hook at the lower edge. This is not shown either. Further, there are transverse webs which are not shown and are oriented parallel to the end walls 5, 6 and are joined to the middle wall 7 at one end and to the longitudinal walls 4 at the other end for defining compartments, which are open at top, in the carrying container 1.

The lower edges of the longitudinal walls 4, 5 are joined to the longitudinal-sided edges of the bottom wall 3 via bottom slopes 11, 12. The bottom slopes 11, 12, extending from the bottom wall 3, are outwardly inclined so that the cross dimension of the compartments slightly increases towards the top in the vicinity of the bottom wall 3.

The compartments have inserted therein bottles 13 with the transverse webs preventing them from contacting each other at the circumferences of their cylindrical convex body area 14. The bottles have an inclined lower edge area 16 between the cylindrical area 14 and their bottoms 15 and, thus, are slightly conical at bottom.

The angle of inclination of the conical external area 16 to the central axis of the bottles 13 approximately coincides with the angle of inclination of the bottom slopes 11, 12 to the middle wall 7 or falls slightly short of it. Further, the cross dimensions of the compartments slightly exceed the diameter of the cylindrical area 14 of the bottles 13. As a result, the bottles 13 can be comfortably inserted into the compartments, but are pinched within the compartments in the lower edge area. This helps avoid a disadvantageous "jerking motion" of the bottles 13 in the compartments. The so-called "drop-jerk test" during which a container carrier filled with bottles 13 is held by the handle 18 and is subjected to rapid up-and-down motions at significant accelerations gives stability values for the inventive container carrier that considerably better than those achieved with conventional container carriers.

Referring to FIG. 3, a cut-to-size panel 17 of a further container carrier has longitudinal walls 18, 19. A bottom wall 20 is hinged to the longitudinal-sided edge of the longitudinal wall 18 via a grooved line. A grooved line 21 subdivides the bottom wall 20 into two portions 20', 20". The area of the grooved line 21 has punched-out regions 22 to introduce strengthening sleeves for a bottle box.

A bottom flap 23 is hinged to the longitudinal-sided edge of the longitudinal wall 19.

End-side wall halves 24', 25' are hinged to the end-sided edges of the longitudinal wall 18 and, accordingly, end-side wall halves 24", 25" are hinged to the end-sided edges of the longitudinal wall 19.

The end-side wall halves 24", 24" have hinged thereto middle wall halves 26', 26". Those have upper handle portions 27', 27" with gripping holes 28', 28". The middle wall portions are joined to each other on the handle portions 27', 27" on a longitudinal middle axis 29 of the cut-to-size portion.

Furthermore, cross webs 30', 30", 31', 31" are punched out in the middle wall halves 26', 26". The webs are hinged to the middle wall halves each 26', 26" at one end and to web flaps 32', 32" at the other end via grooved lines. Here, the cross webs 30', 31' are hinged to a common web flap 32' and the cross webs 30", 31" are hinged to a common web flap 32".

The web flaps 32', 32", in turn, have hinged thereto a end-side flap 33', 33" each on a cross side.

Further, one cross side of the handle portions 27', 27" has hinged thereto outer handle portions 34', 34" with gripping apertures 35', 35" that are joined to each other via a grooved line on the longitudinal central axis 29. The other cross-sides of the outer handle portions 34', 34" have hinged thereto handle reinforcements 36', 36" which are also joined to each other on the longitudinal central axis 29.

On the cross sides, the end-side wall halves 25', 25" have hinged thereto middle webs 37, 37" which have a hook 38', 38" punched out on the outer longitudinal sides and are also joined to each other via a grooved line on the longitudinal central axis 29.

Finally, on a cross side which faces the hook 38', the bottom wall 20 has hinged thereto a reinforcing flap 39 via a grooved line. The reinforcing flap 39 is also subdivided into two halves 39', 39" via a central folding line 40 as a continuation of the central folding line 21. A small rhomboidal punched aperture 41 is located between the central folding lines 21, 40. Further, the reinforcing flap 39 has a punched aperture 42 for a strengthening sleeve that comes to be congruent with the adjoining punched hole 22 after the reinforcing flap 39 is folded against the inner surface of the bottom wall 20. At this point, an edge-sided punched aperture 43 comes to be congruent with an external area of the next punched aperture 22 so that the latter also remains completely free for the insertion of a strengthening sleeve.

The reinforcing flap 39 nearly has the same cross dimension as the bottom wall 20. Its length is approximately equal to half the length of the bottom wall 20.

The container carrier is assembled as follows:

Initially, the middle wall portions 26', 26' are folded against the inner surfaces of the residue of the cut-to-size panel with the handle portions 27', 27" being adhered to the outer handle portions 34', 34", the web flaps 32, 32" to the longitudinal walls 18, 19, and the end-side flaps 33', 33" to the end-side walls 24', 24".

Next, the handle reinforcements 36', 36" are folded against the handle portions 27', 27" and may also be adhered to them.

Afterwards, the end-side wall halves 25', 25" are folded against the inner surfaces of the longitudinal walls 18, 19 with the middle webs 37, 37" being designed to be adhered to the handle reinforcements 36', 36".

Subsequently, the two halves of the pre-assembled cut-to-size panel 17 are folded against each other about the longitudinal central axis 29 with the middle wall portions 26', 26" which abut against each other, and handle portions 27', 27", 34', 34", 36', 36" as well as the middle webs 37', 37" being adhered to each other.

Further, the reinforcing flap 39 is folded against the inner surface of the bottom wall 20 and is adhered thereto. This is advantageously accomplished at the time when the end-side wall halves 25', 25" are folded against the longitudinal walls 18, 19.

Finally, the bottom wall halves 20', 20" are folded against each other while the edge side of the bottom half 20' is adhered to the bottom flap 23.

Figures 4, 5:
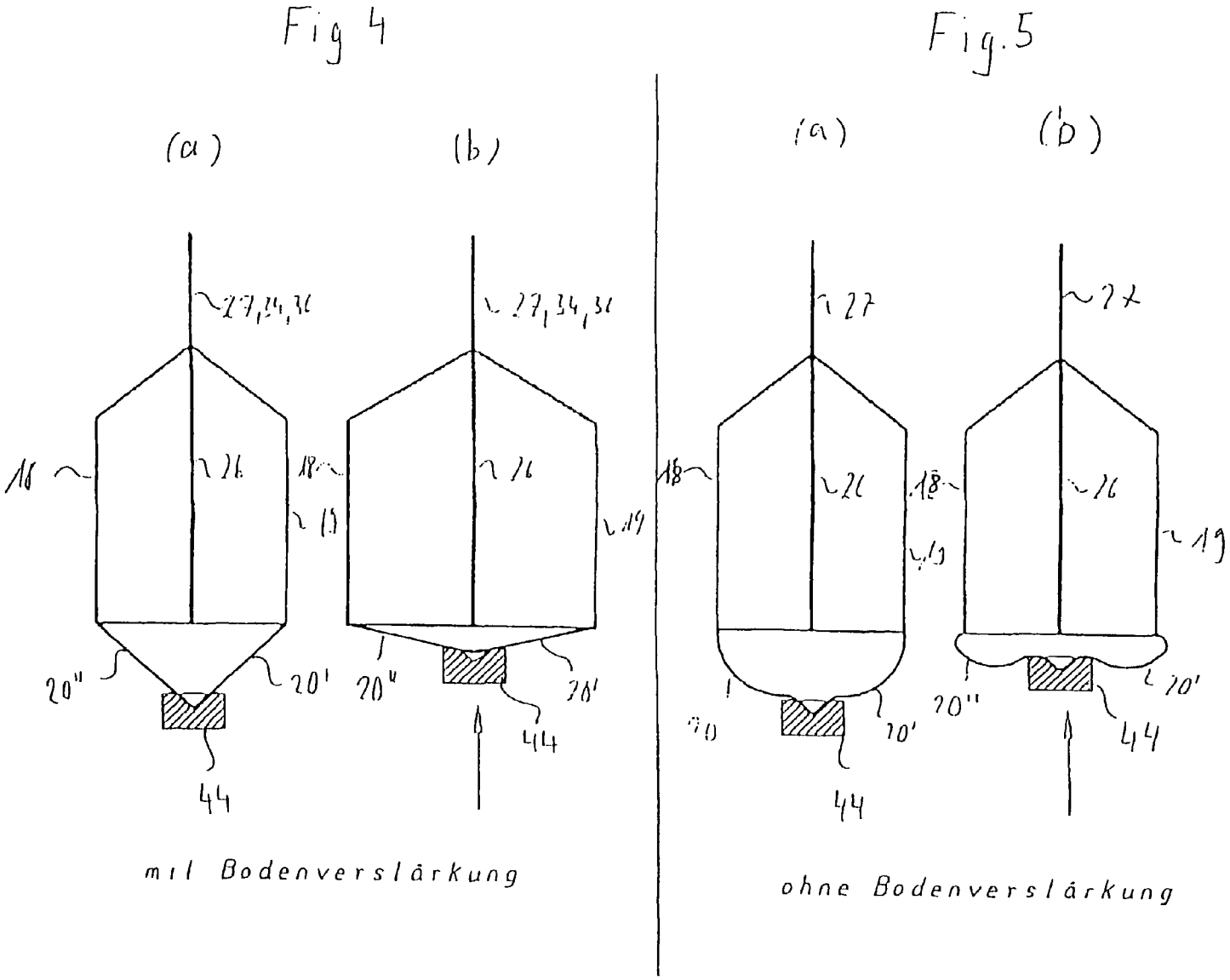
FIG. 4 shows a container carrier having material reinforcements on the bottom wall at the beginning (FIG. 4*a*) and at the end (FIG. 4*b*) of the erecting process in end-side views.
FIG. 5 shows a container carrier having no material reinforcements on the bottom wall at the beginning (FIG. 5*a*) and at the end (FIG. 5*b*) of the erecting process in end-side views.

The pre-assembled flat-lying cut-to-size panel may be set upright by exerting a pressure against the middle of the end-side wall 24', 24" and against the sides of the end-side wall 25', 25". This causes the end-side walls 24', 24", 25', 25" and the cross webs 30', 30", 31', 31" to be folded open and the bottom wall 20 to be spread. The latter is supported, as is shown in FIG. 4, by a press-open device 44 which urges against the edge of the bottom wall 20 to which the reinforcing flap 39 is hinged. As a result, the bottom wall 20 is raised in the direction of the arrow until the hook 38', 38" finally engages the area 41 which is laterally open. The effect of the reinforcing flap 39 is that the cut-to-size panels are not adversely deformed.

The case is different for conventional cut-to-size panels which do not have reinforcements at the bottom wall. Here, the deformations and concurrent damage as are shown in FIG. 5 could occur to the container carrier when the bottom wall 20', 20" is raised.

The above Examples and disclosure are intended to be illustrative and not exhaustive. These examples and description will suggest many variations and alternatives to one of ordinary skill in this art. All these alternative and variations are intended to be included within the scope of the attached claims. Those familiar with the art may recognize other equivalents to the specific embodiments described herein which equivalents are also intended to be encompassed by the claims attached hereto.

The invention claimed is:

1. A container carrier made of a foldable flat material, comprising:

a box-shaped carrying container which is open at top and has a bottom wall, longitudinal walls, and end walls, a middle wall parallel to the two longitudinal walls in the carrying container that has a carrying handle at the top, transverse webs parallel to the end walls between the middle wall and the longitudinal walls for forming compartments in the carrying container to receive containers therein;

outwardly inclined bottom slopes which are joined to the longitudinal-sided edges of the bottom wall at bottom and to the lower edges of the longitudinal walls at the top;

and wherein bottles having lower bottle edges, a bottle axis, and bottle dimensions, are inserted into the carrier and wherein the container carrier has dimensions made to match with the dimensions of the bottles so that the bottles are pinched in the compartments in the area of the bottom slopes;

and further wherein the inclination of the bottom wall slopes towards the middle wall is approximately equal to the inclination of the lower bottle edges towards the bottle axis of the bottles to be inserted into the container carrier or exceeds it somewhat and further wherein the cross dimensions of the compartments in the carrying container, above the area of the bottom slopes, slightly exceed the bottle dimensions, so that the bottle can be comfortably inserted into the compartment and further wherein the bottom slopes being without openings, at least in the area on which the lower bottle edges rest.

2. The container carrier as claimed in claim 1 wherein the middle wall is joined to the end walls at its end sides.

3. The container carrier of claim 1, further comprising:

central folding lines in the end walls and in the bottom wall to planely fold the container carrier, and a material reinforcement which is disposed at a end-sided edge of the bottom wall and extends through the central folding line of the bottom wall.

4. The container carrier as claimed in claim 3 wherein the cross extension of the material reinforcement is substantially equal to the cross extension of the bottom wall.

5. The container carrier as claimed in claim 3 wherein the material reinforcement is a reinforcing flap folded about the end-sided edge of the bottom wall against a side of the bottom wall.

6. The container carrier as claimed in claim 3 wherein the material reinforcement is folded against the inner surface of the bottom wall.

7. The container carrier as claimed in claim 3 wherein the longitudinal extension of the material reinforcement is approximately equal to half the longitudinal extension of the bottom wall.

8. The container carrier as claimed in claim 3 wherein the material reinforcement is adhered to the bottom wall.

9. The container carrier as claimed in claim 1 which is made of a kraft cardboard having a grammage of less than 305 g/m2.

10. The container carrier as claimed in claim 9 which is made of a kraft cardboard having a grammage of 250 g/m2.

11. The container carrier as claimed in claim 3 wherein the middle wall is joined to the end walls at its end sides.

12. A container carrier made of a foldable flat material, comprising:

a box-shaped carrying container which is open at top and has a bottom wall, longitudinal walls, and end walls, a middle wall parallel to the two longitudinal walls in the carrying container that has a carrying handle at the top, transverse webs parallel to the end walls between the middle wall and the longitudinal walls for forming compartments in the carrying container to receive containers therein;

outwardly inclined bottom slopes which are joined to the longitudinal-sided edges of the bottom wall at bottom and to the lower edges of the longitudinal walls at the top;

and wherein bottles having lower bottle edges, a bottle axis, and bottle dimensions, are inserted into the carrier and wherein the container carrier has dimensions made to match with the dimensions of the bottles so that the bottles are pinched in the compartments in the area of the bottom slopes, the bottles having the same dimensions;

and further wherein the inclination of the bottom wall slopes towards the middle wall is approximately equal to the inclination of the lower bottle edges towards the bottle axis of the bottles to be inserted into the container carrier or exceeds it somewhat and further wherein the cross dimensions of the compartments in the carrying container, above the area of the bottom slopes, slightly exceed the bottle dimensions, so that the bottle can be comfortably inserted into the compartment and further wherein the bottom slopes being without openings, at least in the area on which the lower bottle edges rest.

* * * * *